US006544103B1

(12) United States Patent
Korovin

(10) Patent No.: US 6,544,103 B1
(45) Date of Patent: Apr. 8, 2003

(54) METHOD TO DETERMINE OPTIMUM GEOMETRY OF A MULTIZONE CARRIER

(75) Inventor: Nikolay Korovin, Phoenix, AZ (US)

(73) Assignee: Speedfam-IPEC Corporation, Chandler, AZ (US)

( * ) Notice: Subject to any disclaimer, the term of this patent is extended or adjusted under 35 U.S.C. 154(b) by 1 day.

(21) Appl. No.: 09/724,417

(22) Filed: Nov. 28, 2000

(51) Int. Cl.[7] ..... B24B 49/00
(52) U.S. Cl. ..... 451/8; 451/278; 451/9
(58) Field of Search ..... 451/8, 9, 278

(56) References Cited

U.S. PATENT DOCUMENTS 6,343,973 B1 * 2/2002 Somekh ..... 451/289

* cited by examiner

*Primary Examiner*—Joseph J. Hail, III
*Assistant Examiner*—Alvin J. Grant
(74) *Attorney, Agent, or Firm*—Ingrassia Fisher & Lorenz, P.C.

(57) ABSTRACT

The invention is a method for optimizing the geometry of a plurality of zones in a multizone carrier used in a CMP process. This allows a multizone carrier, with a limited number of zones, to be designed that is able to apply, as closely as possible for that number of zones, an optimum pressure on the back surface of a wafer.

An optimum pressure profile may be calculated by subtracting a desired post-CMP thickness profile from a typical incoming thickness profile and dividing the remainder by a polishing removal profile. The optimum pressure profile will generally be impossible to achieve with a limited number of zones within a multizone carrier. However, a carrier with an optimum geometry will be able to apply a pressure profile that is as close as possible given the limited number of zones within the carrier. The optimum geometry of the zones may be calculated using a multidimensional optimization procedure.

8 Claims, 2 Drawing Sheets

Optimum Pressure Profile

Optimum Three-Zone Pressure Profile

METHOD TO DETERMINE OPTIMUM GEOMETRY OF A MULTIZONE CARRIER

TECHNICAL FIELD

The invention relates generally to semiconductor manufacturing, and more specifically to a method to determine the optimum geometry of a multizone carrier used for retaining and pressing a semiconductor wafer against a polishing pad in a chemical-mechanical polishing tool.

BACKGROUND OF THE INVENTION

A flat disk or "wafer" of single crystal silicon is the basic substrate material in the semiconductor industry for the manufacture of integrated circuits. Semiconductor wafers are typically created by growing an elongated cylinder or boule of single crystal silicon and then slicing individual wafers from the cylinder. The slicing causes both faces of the wafer to be extremely rough. The front face of the wafer on which integrated circuitry is to be constructed must be extremely flat in order to facilitate reliable semiconductor junctions with subsequent layers of material applied to the wafer. Also, the material layers (deposited thin film layers usually made of metals for conductors or oxides for insulators) applied to the wafer while building interconnects for the integrated circuitry must also be made a uniform thickness.

Planarization is the process of removing projections and other imperfections to create a flat planar surface, both locally and globally, and/or the removal of material to create a uniform thickness for a deposited thin film layer on a wafer. Semiconductor wafers are planarized or polished to achieve a smooth, flat finish before performing process steps that create integrated circuitry or interconnects on the wafer. A considerable amount of effort in the manufacturing of modern complex, high density multilevel interconnects is devoted to the planarization of the individual layers of the interconnect structure. Nonplanar surfaces create poor optical resolution of subsequent photolithography processing steps. Poor optical resolution prohibits the printing of high density lines. Planar interconnect surface layers are required in the fabrication of modern high density integrated circuits. To this end, CMP tools have been developed to provide controlled planarization of both structured and unstructured wafers.

A carrier in a CMP tools is used to retain a wafer and press against the back surface of the wafer so that the front surface of the wafer is pressed against a polishing pad in the presence of slurry. The amount of pressure at each point on the back surface of the wafer directly affects the amount of pressure between each point on the front surface of the wafer and the polishing pad. This relationship is important because the polishing removal rate at each point on the front surface of the wafer is proportional to the pressure on that point.

In general, it is desirable to remove material from the front surface of the wafer in a substantially uniform manner by applying a uniform pressure on the back surface of the wafer. However, thickness variations in incoming wafers, nonuniform slurry distribution, different motions for different points on the front surface of the wafer and other problems cause nonuniform planarization results. The nonuniform planarization results are typically manifested as concentric bands on the front surface of the wafer were greater or lesser amounts of material were removed. It may therefore be desirable to have different pressures on different concentric bands to create a desired removal rate profile.

Carriers able to provide different pressures on different concentric bands on the back surface of the wafer are referred to as multizone carriers. Multizone carriers can affect the polishing removal rate by applying different polishing pressures on different zones thereby creating a pressure distribution profile. Multizone carriers are typically able to apply different pressures on different zones by having two or more plenums that may be individually pressurized. Each plenum corresponds to a zone or concentric band on the back surface of the wafer. The individually pressurized plenums press against the bands on the back surface of the wafer in order to control the pressures on the front surface of the wafer. The pressure profile on the back surface of the wafer is related to the pressure profile between the front surface of the wafer and the polishing pad and thus the material removal rate profile on the front surface of the wafer. It is therefore highly desirable to be able to apply, as closely as possible, an optimum pressure profile on the back surface of the wafer to produce a desired material removal rate profile on the front surface of the wafer.

Applicant has discovered that the geometry (position and width) for a given number of zones within a multizone carrier limits the possible pressure profiles that may be applied to the back surface of the wafer. Additional zones may be added to the multizone carrier design to improve the flexibility in generating different pressure profiles, but the additional zones greatly increase the expense and complexity of the carrier. Thus, the number of zones that may be designed into the carrier is often limited by external factors. It is therefore important to choose a geometry that allows, as close as possible, an optimum pressure profile to be applied to the back surface of the wafer with a limited number of zones.

What is needed is a method to determine the optimum geometry of a multizone carrier for a particular CMP process.

SUMMARY OF THE INVENTION

The invention is a method for optimizing the geometry of a plurality of zones in a multizone carrier used in a CMP process. This allows a multizone carrier, with a limited number of zones, to be designed that is able to apply, as closely as possible, an optimum pressure distribution profile on the back surface of a wafer.

A typical pre-CMP thickness profile needs to be found for the incoming wafers. The process prior to the CMP process, usually a deposition process, will typically leave concentric troughs and bulges of material on the incoming wafers. By measuring wafers representative of expected incoming wafers and averaging the results, a typical thickness profile may be calculated.

A desired post-CMP thickness profile for the wafers must also be found. The desired post-CMP thickness profile is dependent on the needs of the overall manufacturing process for the wafer. A specific example of a post-CMP profile is a layer with a flat surface of a particular thickness.

A polishing removal profile for a given CMP process must also be found. This may be done by polishing a wafer using a single-zone carrier. This data will reveal how uniformly the planarization process itself removes material from the front surface of the wafer. CMP processes, even when a uniform pressure is placed on the back surface of the wafer, are commonly nonuniform. The required polishing removal profile takes the nonuniformity of the CMP process into account for the design of the multizone carrier.

An optimum pressure profile may be calculated by subtracting the desired post-CMP thickness profile from the typical incoming thickness profile and dividing the remainder by the polishing removal profile. The optimum pressure profile will generally be impossible to achieve with a multizone carrier. However, a carrier with an optimum geometry will be able to apply a pressure profile that is as close as possible for a given limited number of zones within the carrier. The optimum geometry of the zones may be calculated using a multidimensional optimization procedure.

BRIEF DESCRIPTION OF THE DRAWINGS

The present invention will hereinafter be described in conjunction with the appended drawing figures, wherein like numerals denote like elements, and.

DETAILED DESCRIPTION OF EXEMPLARY EMBODIMENTS

A method utilized in the polishing of semiconductor substrates and thin films formed thereon will now be described. In the following description, numerous specific details are set forth illustrating Applicant's best mode for practicing the present invention and enabling one of ordinary skill in the art to make and use the present invention. It will be obvious, however, to one skilled in the art that the invention may be practiced without these specific details. In other instances, well-known machines and process steps have not been described in particular detail in order to avoid unnecessarily obscuring the invention.

Figure 1:
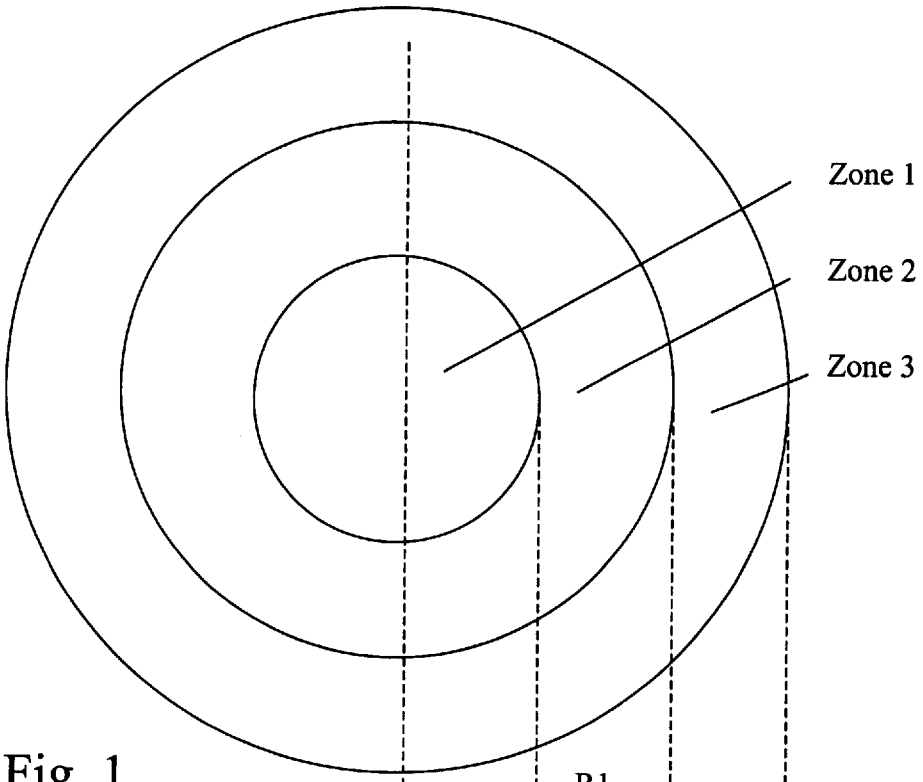
FIG. 1 is a simplified bottom plan view of a multizone carrier having three zones.

The invention is a method to determine the optimum location and width for each zone of a multizone carrier for a particular planarization process. FIG. 1 shows a plan view of a multizone carrier having three zones. The method may be used to assist the designer of a multizone carrier, once the number of zones has been selected, in determining the location and width for each zone. The number of zones for a multizone carrier may be selected based on the desired flexibility and the acceptable expense and complexity for the carrier. A carrier with more zones will typically have greater flexibility, but will be more expensive and have greater complexity. Greater complexity for the carrier means it will be more difficult to build, use, maintain and repair. Thus, a carrier design will preferably use the minimum number of zones that still allows the carrier to adequately planarize incoming wafers.

The expected thickness profile for incoming wafers (Pre (X)) may be found (step 300) and used in determining the optimum geometry for a multizone carrier. A deposition process, while depositing a thin film on the wafer, will typically deposit the thin film with concentric troughs and bulges. The thickness profile for a particular wafer may be measured using a metrology system from KLA-Tencor of San Jose, Calif. known as the P2, but other systems may also be used. The expected thickness profile for incoming wafers may thus be calculated by averaging the thickness measurements from a selected number of wafers representative of those that will be planarized with the multizone carrier.

A desired post-CMP thickness profile for the wafers may also be determined (Post(X)) (step 301) and used in the process of determing the optimum geometry for a multizone carrier. The desired post-CMP thickness profile is dependent on the manufacturing process for the semiconductor. For example, an insulator layer will typically need to be a different thickness than a conductive layer of a semiconductor. The density of the integrated circuitry may also influence the desired post-CMP thickness. The invention may be used to satisfy a wide range of desired post-CMP thickness profiles.

Even with a uniform pressure on the back surface of a wafer, a planarization process will rarely remove material from the front surface of the wafer in a uniform manner. The type of motion between the wafer and polishing pad, types of consumables used and other factors will cause areas (typically in concentric bands) to have material removed faster or slower than other areas. A polishing removal profile (PR(X)) for a given CMP process may be found by polishing a predetermined number of wafers and determining how much material was removed (step 302). The carrier is preferably a single-zone carrier, but may also be a multizone carrier where all zones press against the wafer with the same pressure, to insure a uniform pressure is applied to the back surface of the wafer. The polishing removal profile (PR(X)) for the CMP process may be calculated by taking before and after measurements of the wafer using the P2 metrology instrument.

Figure 2:
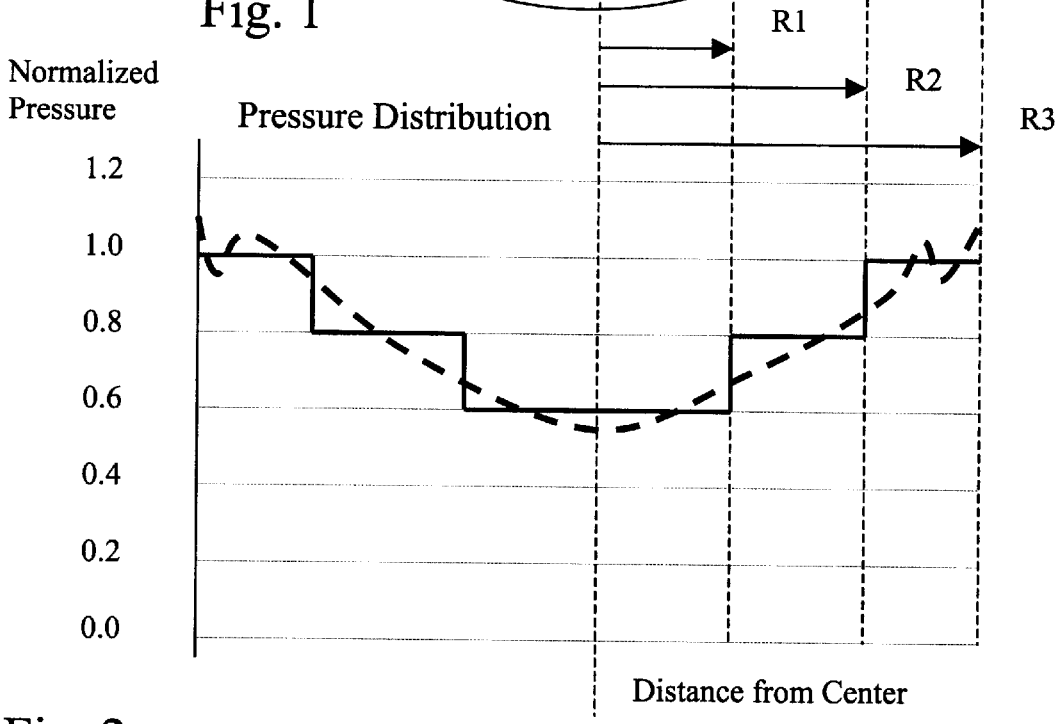
FIG. 2 is a Pressure Distribution chart illustrating an optimum pressure profile and an optimum three-zone carrier pressure profile.
Figure 3:
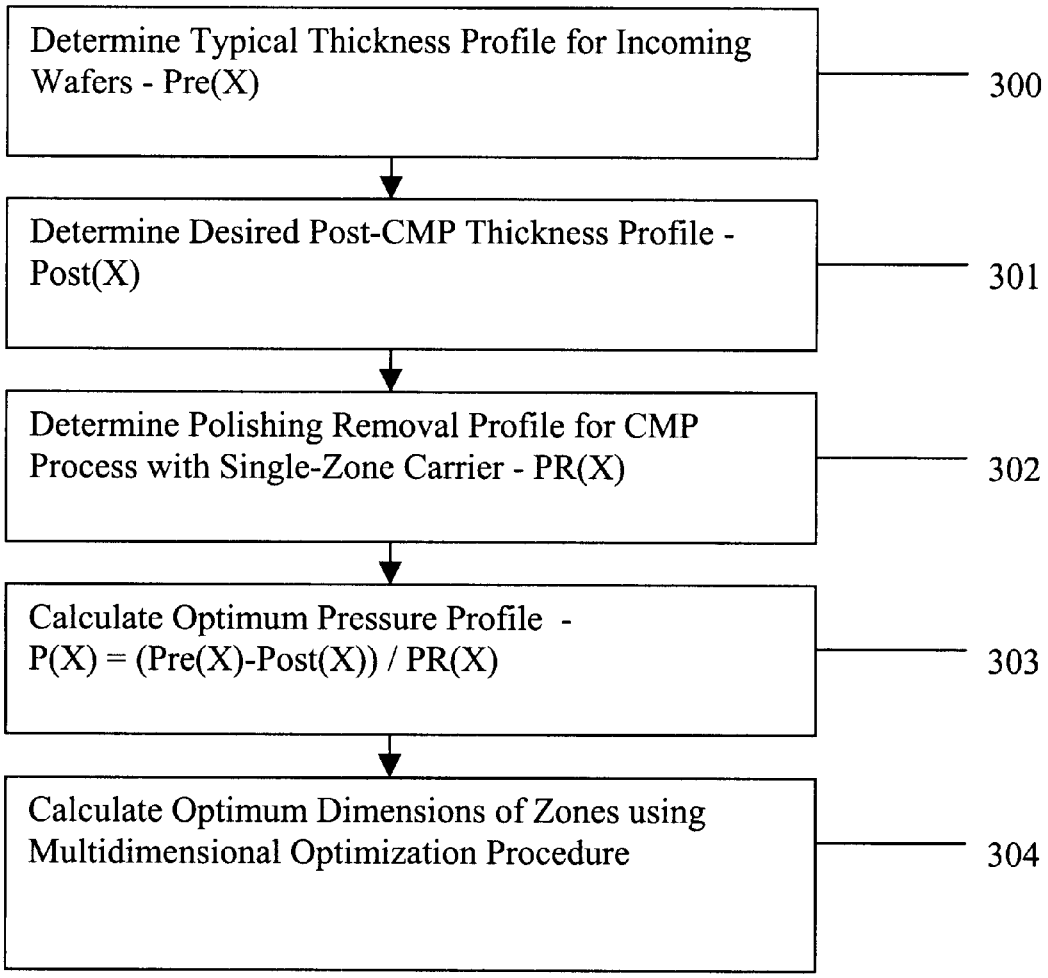
FIG. 3 is a flow chart of the preferred method to determine the optimum geometry of a multizone carrier.

Once the expected thickness profile for incoming wafers (Pre(X)), the desired post-CMP profile (Post(X)) and the polishing removal profile (PR(X)) have been determined, an optimum pressure profile (P(X)) is illustrated in FIG. 2 and may be found as follows (step 303):

$$P(X)=(\mathrm{Pre}(X)-\mathrm{Post}(X))/PR(X)$$

The optimum dimensions for the zones in a multizone carrier may now be calculated using a multidimensional optimization procedures (step 304).

A carrier will create a particular pressure distribution profile on the back surface of a wafer depending on the number of zones and the pressure within each zone. This step profile may be approximated as a number of steps with step highs proportional to the pressure in the zone and the width of the steps proportional to the width of the zones. The optimization procedure determines a combination of pressures in the zones and a combination of zonal dimensions that minimize the difference between the step profile and an optimum pressure profile. The difference may be measured, for example, as the standard deviation between the curves, area between the curves or an absolute range of difference. The optimum combination of pressures and dimensions may be found by applying one of the well known multidimensional optimization procedures. For example, Marquardt's quadratic optimization, Golden section search method or others may be used. The preferred embodiment utilizes the Nelder-Mead direct search method for multidimensional optimization.

An example of an optimum pressure profile is shown in FIG. 2. A multizone carrier, by its nature, applies a step-like pressure profile on the back surface of the wafer. An example of this step-like pressure is also shown in FIG. 2 as an optimum three-zone pressure profile. The multidimensional optimization procedure allows a carrier to be designed that minimizes the differences (areas between the curves) between the optimum pressure profile and the optimum three-zone (or any number of zones) pressure profile. By minimizing the differences between the two curves, the multizone carrier will be able to apply as closely as possible, given its limited number of zones, the optimum pressure profile.

While the invention has been described with regard to specific embodiments, those skilled in the art will recognize that changes can be made in form and detail without departing from the spirit and scope of the invention. For example, while a three-zone carrier was used to describe the invention, multizone carriers having a different number of individually controllable pressure regions may be used.

I claim:

1. A method for optimizing the geometry of a multizone wafer carrier having a plurality of polishing zones comprising the steps of:

a) determining a typical incoming thickness profile for wafers prior to CMP;

b) determining a desired post-CMP thickness profile for the wafers;

c) calculating an optimum pressure profile by subtracting the desired post-CMP thickness profile from the typical incoming thickness profile; and d) calculating the optimum dimensions of a plurality of zones within the multizone carrier using a multidimensional optimization procedure.

2. The method of claim 1 wherein the multidimensional optimization procedure comprises a Nelder-Mead direct search method.

3. The method of claim 1 wherein the multidimensional optimization procedure comprises a Marquardt's quadratic optimization.

4. The method of claim 1 wherein the multidimensional optimization procedure comprises a golden section search method.

5. A method for optimizing the geometry of a multizone wafer carrier having a plurality of polishing zones comprising the steps of:

a) determining a typical incoming thickness profile for wafers prior to CMP;

b) determining a desired post-CMP thickness profile for the wafers;

c) determining a polishing removal profile for a given CMP process using a uniform pressure profile against the back surface of the wafers;

d) calculating an optimum pressure profile by substracting the desired post-CMP thickness profile from the typical incoming thickness profile and dividing the remainder by the polishing removal profile; and e) calculating the optimum dimensions of the plurality of zones within the multizone carrier using a multidimensional optimization procedure.

6. The method of claim 5 wherein the multidimensional optimization procedure comprises a Nelder-Mead direct search method.

7. The method of claim 5 wherein the multidimensional optimization procedure comprises a Marquardt's quadratic optimization.

8. The method of claim 5 wherein the multidimensional optimization procedure comprises a golden section search method.

* * * * *